United States Patent [19]

Gringer

[11] Patent Number: 4,558,517

[45] Date of Patent: Dec. 17, 1985

[54] SCRAPER HAND TOOL

[76] Inventor: Donald Gringer, Bishop Rd., Bedford, N.Y.

[21] Appl. No.: 556,439

[22] Filed: Nov. 30, 1983

[51] Int. Cl.[4] ..... B26B 3/00

[52] U.S. Cl. ..... 30/169; 15/93 R; 30/151; 30/162

[58] Field of Search ..... 30/169, 172, 162, 163, 30/151, 161; 15/93 R

[56] References Cited

U.S. PATENT DOCUMENTS

| | | | |
|---|---|---|---|
| 2,291,514 | 7/1942 | Warner et al. | 30/162 |
| 2,548,797 | 4/1951 | Ingwer et al. | 30/162 |
| 2,601,723 | 7/1952 | Keller | 30/169 X |

*Primary Examiner*—Douglas D. Watts

*Attorney, Agent, or Firm*—Stiefel, Gross, Kurland & Pavane

[57] ABSTRACT

An improved scraper hand tool includes upper and lower housing members defining a hollow casing and an operating member axially movable therein to carry a blade between a first interior storage position, a second cutting edge protracted position, and a third blade removal and insertion position. The operating member presents a full beam suspension design wherein a central thumb operating portion projects through a slot in the casing for operative manipulation by a user. Locking detents in the housing interior cooperate with laterally-extending arms on the movable operating member to assure positive positional locking of the blade in each of its respective positions.

14 Claims, 7 Drawing Figures

FIG. 2A
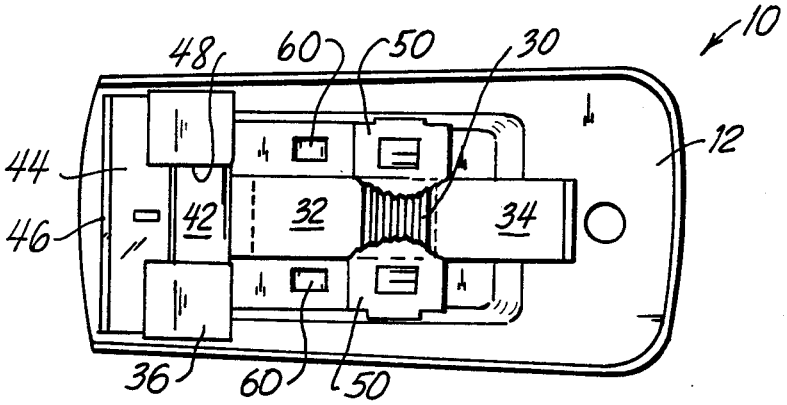
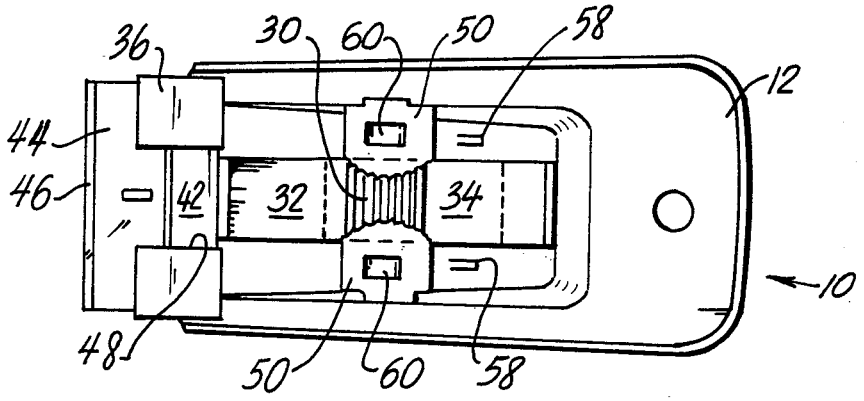
FIG. 2B
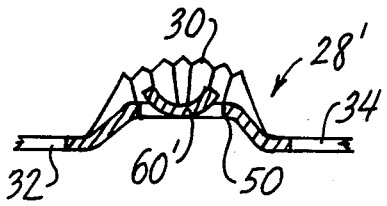
FIG. 5A
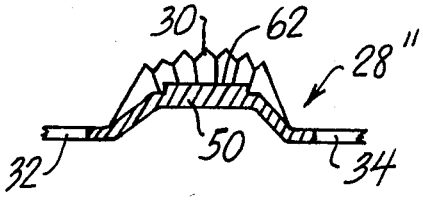
FIG. 5B

SCRAPER HAND TOOL

TECHNICAL FIELD

The present invention relates generally to hand tools, and more particularly to an improved hand scraper in which the blade is selectively reciprocatable into and out of protective position.

BACKGROUND OF THE INVENTION

In painting, refinishing, or otherwise treating surfaces proximate glass, paint or other liquids often spatter onto the glass and, once dry, can prove particularly troublesome to remove. It is conventional in such circumstances to utilize a planar blade to scrape the spatterings from the glass and a multiplicity of hand tools have long been available to facilitate retention and operative manipulation of the blade by a user.

One such hand scraper tool is disclosed in U.S. Pat. No. 2,291,514 of Warner et al. That scraper includes a hollow body within which a blade-carrying member is user-slidable to reciprocate the blade between a storage position within the handle and an operating position in which the cutting edge of the blade projects outward from the handle's open end. The movable member is of a three-finger cantilever design in which the outer fingers, and the central or middle finger, are spring biased in opposite directions for frictionally engaging opposite interior walls of the hollow handle. The free end of the middle finger extends through a slot in the handle for user access and operative manipulation in sliding the blade between its first and second positions. Widthwise extensions of the slot at its longitudinal ends cooperatively receive the middle finger to define the first and second positions of the blade and so lock the member against unintended positional slippage.

The Warner et al hand tool, however, is deficient in several respects that prevent full realization of its potential operating benefits. The three-finger cantilever design lacks substantial rigidity in that the central, operating finger is supported from only a single point. In addition, the movable member is in fact prone to unpredictable rearward slippage—when the tool is used in its normal manner for scraping—that results in jamming of the operating mechanism and possible injury to the user. Since the Warner et al tool provides the ability to change the blade while disposed in its operative position, there exists a further risk and danger of inadvertent disengagement of the blade from the tool in the course of normal use.

It is accordingly the desideratum of the invention to provide a hand scraper tool that overcomes the deficiencies of the prior art. More particularly, it is an object of the invention to provide a hand tool in which a scraper blade is selectively reciprocatable between, and positively securable in each of, an operating position and an interior storage position.

It is another object of the invention to provide such a hand tool in which inadvertent disengagement of the blade from the tool in the operating position of the blade is positively prevented.

It is a further object of the invention to provide such a hand tool wherein the movable blade-carrying member exhibits increased rigidity facilitating member movement between its various positions.

It is yet another object of the invention to provide such a hand tool in which the slidable member is movable to, and positively retained in, a third position for removal and/or insertion of a blade.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference numerals denote similar elements throughout the several views:

FIGS. 2A and 2B are sectional bottom plan views taken along the line 2—2 in FIG. 1, wherein FIG. 2A illustrates the blade in fully retracted position and FIG. 2B illustrates the blade in intermediate scraping position;

FIGS. 5A and 5B are sectional fragmentary side views of alternate constructions of the operating member or slider in accordance with the invention.

DETAILED DESCRIPTION OF THE PREFERRED EMBODIMENT

Figure 1:
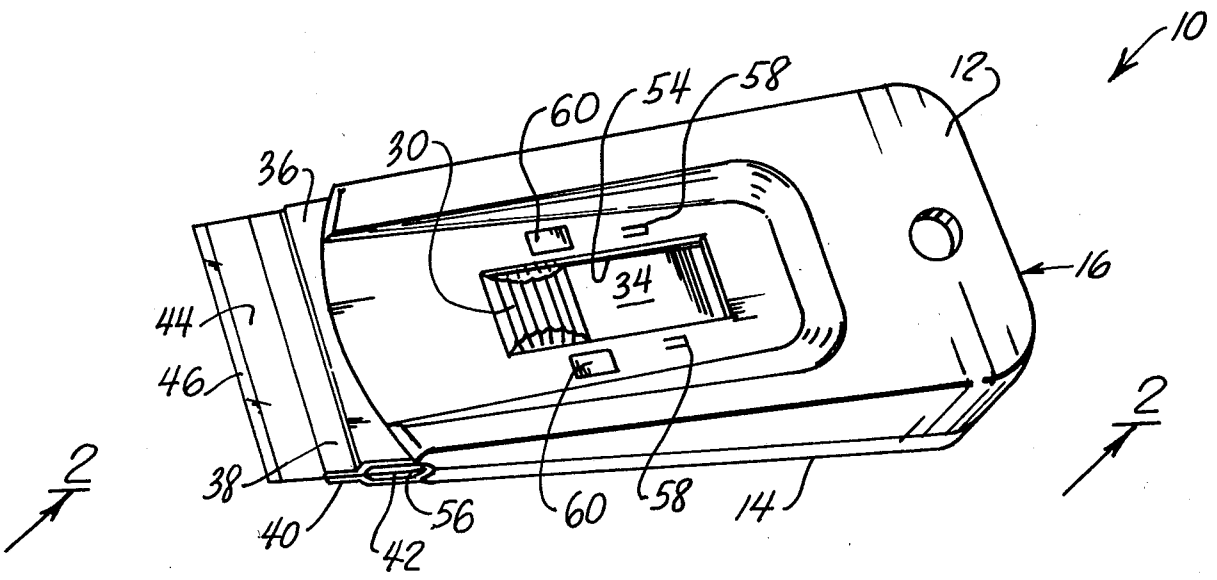
FIG. 1 is an elevated perspective view of a scraper hand tool constructed in accordance with the teachings of the invention with the cutting blade in fully extended position.
Figure 3:
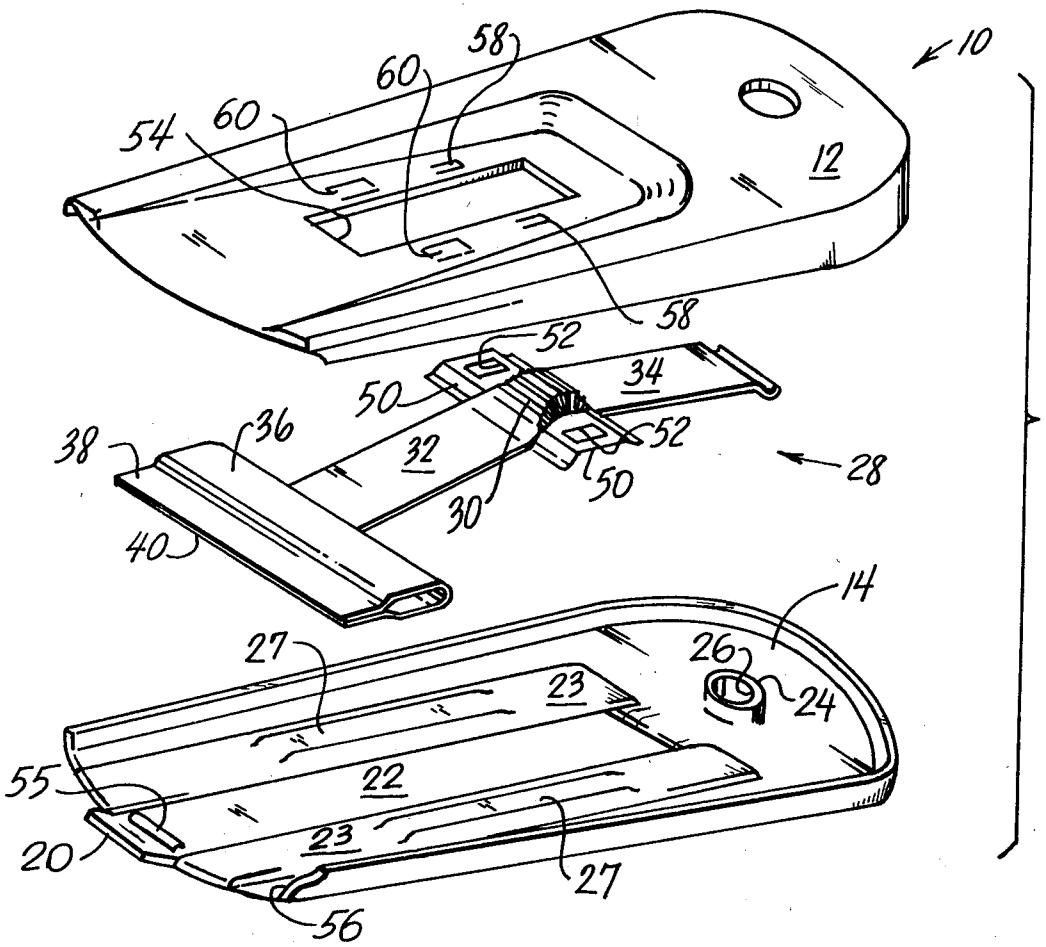
FIG. 3 is an elevated perspective exploded view of the tool of FIG. 1.

Referring now to the accompanying drawings, a preferred embodiment of an improved scraper hand tool constructed in accordance with the invention is identified by the general reference numeral 10. Upper and lower housing members 12, 14, each of which may typically comprise a stamped metal member, are welded or otherwise joined together at their abutting rims to define a hollow tool handle or casing 16. It is presently preferred that members 12, 14 be joined by projection welding along their rims for added assembly strength. Those skilled in the art, after attaining an understanding of the invention in accordance with this disclosure, will recognize that casing 16 may be cast or stamped in two joinable elements, as shown or may alternatively be molded of suitable material in either one or two pieces.

The assembled casing 16, which is shown by way of example as generally rectanglar and somewhat tapered in cross-section in the direction of its forward or head end, is thus closed around its lateral and rear edges. Its head or forward end edge defines an open mouth 18 through which a scraping blade is extendable in a manner hereinafter described. A central flange 20, formed as a partial lip, may additionally be provided on one of the housing members—such as lower member 14—at and extending confrontingly before open mouth 18.

Lower housing member 14 further includes a central longitudinally extending channel 22 defined between spaced parallel ribs 23 and extending between flange 20 at its head end and the upstanding collar 24 of an opening 26 at its rear end. A similar collar and aligned opening are provided on upper housing member 12 to together define a bore extending fully through casing 16. Each rib 23 carries an elongated land 27 along a portion of its length.

Hand tool 10 also includes an integral, longitudinally slidable operating member generally designated 28 and disposed in the hollow interior of casing 16. Member 28 comprises an axially elongated body having a central thumb or finger controlled actuating portion 30 and unitary respective forward and rear legs 32, 34 longitudinally extending from portion 30. The outboard end of each leg 32, 34 remote from central thumb portion 30 is angled or bent out of the plane of the leg to define an abutment surface in the operative use of tool 10 as will hereinafter be described. Thumb portion 30 is preferably convexly arched and knurled to facilitate operative user-effected manipulation of member 30.

Forward leg 32 carries, at its bent head end, a spring or compression clamp 36. Clamp 36 is formed of jaws 38, 40 between which the reinforced back 42 of a blade 44 is received by sliding the blade back laterally into engagement between the jaws. It is generally intended that blade 44 be of conventional rectangular design having its cutting edge 46 opposite the reinforced back 42. It should further be noted that lower jaw 40 includes a central cutout 48 which substantially conforms in width to that of housing flange 20.

Operating member or slider 28 additionally includes a pair of arms 50 extending laterally outward from central operating portion 30. A generally rectangular opening 52 is defined in each lateral arm 50.

Figure 4:
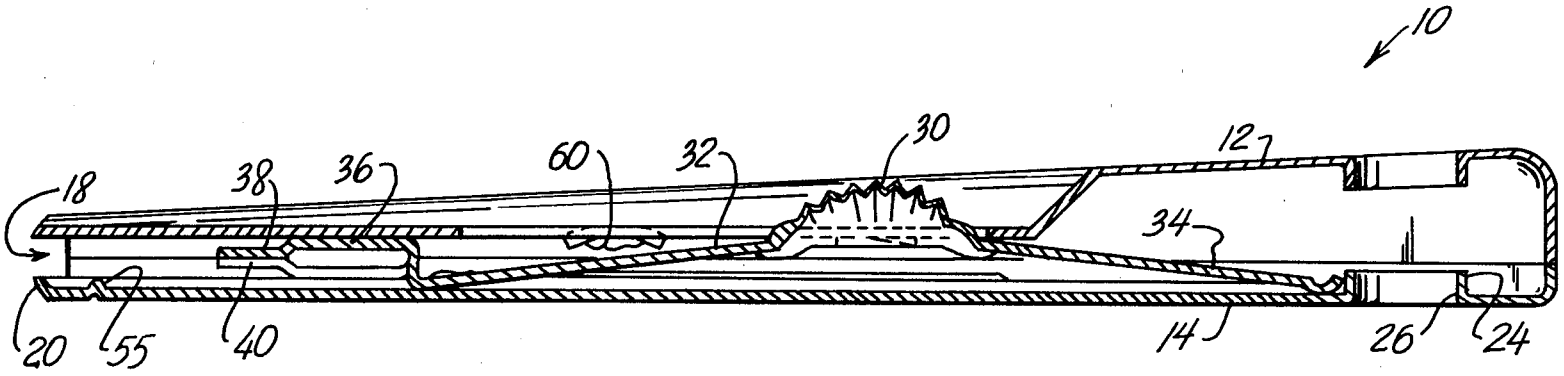
FIG. 4 is a sectional view of the scraper hand tool of FIG. 1.

Operating member 28 is, as previously noted, of integral construction and is formed of a spring-type or similar material by which the same is rendered resiliently deformable. It is preferred, but not required, that the entire member 28 be fabricated as a single, unitary body to thereby impart structural integrity and rigidity in operative use of the tool and to eliminate the possibility of joint or material failure by which portions of member 28 might otherwise become detached during such use. It should in any event be recognized that in the manufactured configuration of operating member 28 legs 32, 34 are ramped or inclined upwardly toward thumb portion 30 so that, in essence, thumb portion 30 is normally maintained in an uplifted or raised position and is thus supported on the remote ends of legs 32, 34. Put another way, and as perhaps best seen in FIG. 4, legs 32, 34 form an axially elongated full beam suspension of central thumb portion 30 and laterally extending arms 50. This arrangement provides notably increased structural rigidity and stability over that present in prior art scraper hand tools.

With operating member 28 disposed axially slidably within hollow tool casing 16, the outboard ends of legs 32, 34 are received for movement in and along lower housing member channel 22. For this purpose, the width of at least the outboard ends of legs 32, 34 should substantially conform to the width of channel 32. Knurled thumb portion 30 of operating member 28 projects upwardly through an axially elongated slot 54 defined in upper housing member 12 to enable user access thereto by which selective movement of member 28—and correspondingly of a clamp-carried blade 44—is attainable. In the presently preferred embodiment herein disclosed, operating member 28 is slidable to and between three discrete positions. In the first, member 28 is withdrawn to its rearmost position wherein blade 44 is fully retracted and enclosed within casing 16 in its storage or safety condition; the bent outboard end of rear leg 34 abuts collar 24 of lower housing member 14 to define this first position and prevent rearward axial overtravel of operating member 28.

From its first position, member 28 is slidable (toward the head end of casing 16) to a second position in which the cutting edge 46 of blade 44 projects in protracted condition through the open mouth 18 of the tool casing. As best seen in FIG. 2B, the forward extension of operating member 28 in this second position is such that at least a portion of blade 44 rearward of its cutting edge 46 remains within the hollow defines of casing 16. As a consequence, blade 44 may not be removed, either intentionally or otherwise, from securement between opposed jaws 38, 40 in the second or operative position of member 28. It should be further noted that, in this second position—and as member 28 moves between its first and second positions—flange 20 on lower housing member 14 is accomodated by cutout 48 in jaw 40 which arrangement, as should be readily appreciated, stabilizes and secures clamp 36 against undesired lateral movement and thereby facilitates use of the blade for normal scraping, or for angled cutting or slitting with a corner or edge of the blade, or in any other desired manner.

From its second position, operating member 28 is further outwardly slidable an additional increment therebeyond to a third position in which blade 44 is disposed for lateral removal and/or insertion between opposed clamping jaws 38, 40. This third position is defined by abutment of the bent outboard or forwardmost end of forward leg 32 with an upstanding ridge stop 55 defined in channel 22 proximate flange 20. Of course, even were operating member 30 to somehow travel forward beyond its third position, the bent end of leg 32 would immediately thereafter contact flange 20, preventing any further forward travel of member 30 and blade 44. Thus, flange 20 will be understood to serve a dual purpose—it both cooperates with cutout 48 of jaw 40 to operatively stabilize compression clamp 36 and, should member 30 somehow overtravel its third position, serves as a safety stop to limit further forward movement and thereby prevent injury to the user.

The disposition of blade-retaining clamp 36 in the third position of member 28 is such that a blade 44 is laterally slidable into and out of engagement between jaws 38, 40. For this purpose, the full blade-receiving extent of jaws 38, 40 may project outwardly through and beyond open casing mouth 18; alternatively, as in the illustrated embodiment, a notch 56 may be defined in one of the lateral edges of the casing adjacent mouth 18 and through which the rearmost portion of reinforced blade back 42 can be moved in the third position of operating member 30.

As the outboard ends of operating member legs 32, 34 ride in and are axially guided by channel 22 of lower housing member 14, the full beam suspension arrangement of member 28 maintains thumb operating portion 30 in projecting relation through slot 54 in upper housing member 12. Likewise, lateral arms 50 are urged and biased into frictional engagement with the interior wall of upper housing member 12. Upper member 12 is additionally provided with a series of locking detents for cooperative engagement with arm openings 52 so as to assure positive locking retention of operating member 28 in each of its three positions along casing 16.

More particularly, a first pair of detents 58 are defined in upper housing member 12 for cooperation with arm openings 52 in the first position of operating member 28. Each of the detents 58 defines a rearward facing step or edge for engagement with the rearward edge or bound of the corresponding arm opening 52 so that forward movement of member 28 is inhibited by such engagement; disengagement is, however, readily accomplished by user application of downward or inward force to knurled operating portion 30 by which frictional contact between arms 50 and the interior surface of upper housing member 12 is resiliently broken.

A second pair of detents 60 project into the interior of casing 16 from upper housing member 12 forwardly of first detents 58. Each of these second detents 60 present both forward and rear facing step-like edges which are spaced apart for concurrent engagement with the corresponding forward and rear edge-defining bounds of a respective arm opening 52 in the second position of member 28. This arrangement assures that, in normal use of the device, blade 44 cannot unexpectedly shift in either axial direction with a consequent risk of user injury. The double edge engagement of detents 60 with arm openings 52 further provides increased stability in attaining a positive positional lock of operating member 28 in its second position in which a variety of differently directed forces will typically be applied to the blade. The latching or locking engagement of arm openings 52 with detents 60 is nevertheless readily releasable by the user through an application of inwardly-directed force to thumb portion 30 so that arms 50 are carried out of frictional contact with the interior surface of upper housing member 12.

The projection of each detent 60 into the hollow casing interior further incorporates an axially concave depression between its forward and rear facing edges so that, in effect, a side view of each detent 60 somewhat resembles a severely flattened U-contoured boss. In the third position of operating member 28, the rearward edge-defining bound of each arm opening 52 seats within the depression of the corresponding detent 60 to thereby discourage rearward axial movement of member 28. However, the impediment to rearward movement of member 30 from its third position by virtue of this arrangement is intended to merely discourage—rather than positively prevent—such movement. As a consequence, after insertion of a blade into clamp 36 in the third position of member 30, an application of rearwardly-directed force to the cutting edge 46 (as by utilizing the hand tool 10 for scraping in a conventional manner) drives operating member 30 rearward into locked condition in its second position. If desired, of course, a more positive lock can be provided for the third or loading position of member 30 in the manufacture of tool 10.

In use, casing 16 of tool 10 is held in the palm of the user's hand with the thumb resting atop operating portion 30. With member 28 in its first position with full protective retraction of the blade, inward pressure is applied to operating portion 30 while the same is simultaneously moved toward the second position with a corresponding application of forward-directed force. When operating member 28 and blade 44 have attained the second position, an audible click will be evident as double-sided detents 60 lock into positive engagement with arm openings 52. The scraping tool may then be utilized in any conventional or desired manner with the axial position of the blade firmly and positively retained by the cooperating double detent locking arrangement.

Following such use, operating member 28 may be returned to its first position, or alternatively moved to its third position to enable removal or replacement of blade 44, by a concurrent application of inwardly directed (to disengage the double detent lock) and appropriate rearward or forwardly directed (to attain the first or third positions) force through manipulation of the user's thumb on knurled operating portion 30.

The disclosed construction of scraper tool 10 incorporates double detents 60 on the interior surface of upper housing member 12 and appropriately configured openings 52 in sliding member arms 50 for second position locking engagement therewith. It is also within the scope and contemplation of the invention, however, that this arrangement be reversed so that the arms 50 carry the elements for releasable locking engagement with suitable openings in housing member 12. Thus, FIGS. 5A and 5B illustrate alternate constructions of the relevant portions of operating member 28, there designated 28' and 28'', respectively.

In FIG. 5A, the arms 50 of member 28' include double detents 60' stamped or otherwise defined upstandingly therein for engagement with corresponding openings (not shown) in the upper housing member. Detents 60' are substantially identical in configuration to detents 60 on member 12 best illustrated in FIG. 4 with respect to the first disclosed embodiment of the invention.

FIG. 5B contemplates molding of operating member 28'' of a suitable material. In this case, the double-edged detents each comprise an upstanding land or platform 62 shaped and sized for releasable receipt within an appropriate opening (not shown) in the upper housing member. Other arrangements and configurations of releasable locking structures will, of course, be apparent to those skilled in the art and are considered to be within the scope of the invention.

While there has been shown and described and pointed out fundamental novel features of the invention as applied to a preferred embodiment thereof, it will be understood that various omissions and substitutions and changes in the form and details of the invention illustrated and in its operation may be made by those skilled in the art without departing from the spirit of the invention. It is the intention, therefore, to be limited only as indicated by the scope of the claims appended hereto.

What is claimed is:

1. An improved scraper hand tool for use with a blade having a cutting edge, comprising:

an elongated hollow casing having an elongated slot axially defined in one wall thereof and an open mouth at the forward end of the casing;

an integral operating member of resilient material disposed for axial movement within said casing and comprising an axially elongated body clamp means on the forward end of said body for releasably receiving a blade, a thumb-controlled actuating portion disposed substantially centrally along said body, and a pair of arms extending laterally outward from and beyond the elongated body at said actuating portion;

the axially forward and rearward ends of said body, and said actuating portion and lateral arms, being biased in respectively opposite directions toward opposite interior walls of the hollow casing in a full beam suspension arrangement in which both of said ends of said body are supported, and said lateral arms are urged into positive engagement with said opposite interior walls and said actuating portion is urged into projecting relation through said casing slot for manipulative access by a user's thumb in effecting selective axial movement of said operating member;

said operating member being axially movable in a channel in one of said interior walls between a first position in which a blade carried by said clamp means is protectively disposed fully within said hollow casing, and a second position in which the blade is maintained in operative position with its cutting edge projecting from said casing; and lateral lock means for each of said lateral arms for releasably securing said full beam suspension operating member in said second position, each of said lateral lock means comprising detent means cooperative with an opening for releasably locking said lateral arms to said interior casing wall in a positive engagement, said opening and detent means being automatically engaged as said full beam suspension operating member is moved to said second position and being disengagable through inwardly directed thumb-applied force on said actuating portion to thereby urge said lateral arms out of said positive engagement with said interior casing wall and enable axial movement of said full beam suspension operating member from said second position while enabling said full beam suspension arrangement to be maintained; whereby substantial rigidity may be maintained throughout said axial movement.

2. An improved scraper hand tool in accordance with claim 1, wherein said lateral lock means comprises an opening in each said lateral arm and detent means on said interior casing wall with which said arms are urged into positive engagement.

3. An improved scraper hand tool in accordance with claim 2, the blade in said second position of said operating member being maintained against release from said clamp means, and said operating member being axially movable to a third position in which the blade sufficiently projects from said casing to permit its selective release from and receipt in said clamp means.

4. An improved scraper hand tool in accordance with claim 3, said casing further including an axially elongated channel defined in the interior casing wall into which the ends of said body are biased, for receiving said body ends and for guiding the same as said operating member is axially moved within said hollow casing.

5. An improved scraper hand tool in accordance with claim 4, further comprising stop means defined in said casing proximate the forward end of said channel for predeterminately limiting forward axial movement of said operating member therealong to said third position of the operating member.

6. An improved scraper hand tool in accordance with claim 3, further comprising a flange defined on the forward end of said casing and cooperable with said clamp means in said second and third positions of the operating member to stabilize said clamp means and a blade carried thereby during operative use of said tool.

7. An improved scraper hand tool in accordance with claim 3, said detent means comprising a pair of double-sided detents each for receipt in and dimensionally conforming to a respective one of said arm openings in said second position of the operating member.

8. An improved scraper hand tool in accordance with claim 7, each said arm opening including a forward and a rear disposed edge, and each said double-sided detent including forward and rear disposed edges for cooperative engagement with the corresponding edges of a respective one of said arm openings.

9. An improved scraper hand tool in accordance with claim 8, each said double-sided detent further comprising a concave depression intermediate its forward and rear disposed edges for receiving the rear disposed edge of a respective one of said arm openings in said third position of the operating member to thereby discourage rearward axial movement of the operating member from its third position during removal or insertion of a blade in said clamp means, said depression being so configured that, after insertion of a blade into said clamp means in said third position of the operating member, rearwardly-directed user-applied force on the cutting edge of the blade causes said operating member to move to and be automatically locked in said second position for normal use of said tool.

10. An improved scraper hand tool in accordance with claim 4, further comprising means on said casing proximate the rearward end of said channel for cooperative engagement with the rearward end of said body to prevent rearward axial movement of said operating member therebeyond and so define said first position of the operating member.

11. An improved scraper hand tool in accordance with claim 3, further comprising second lock means for releasably securing said operating member in said first position.

12. An improved scraper hand tool in accordance with claim 11, said second lock means comprising a pair of rearward-facing detents for respective engagement with said arm openings in said first position of the operating member for releasably preventing forward movement of said operating member from its first position.

13. An improved scraper hand tool in accordance with claim 3, said operating member being unitarily formed of a single piece of resilient material.

14. An improved scraper hand tool in accordance with claim 1 wherein said lateral lock means comprises detent means on each of said lateral arms and corresponding openings in said interior casing wall.

* * * * *